United States Patent [19]

Onishi et al.

[11] Patent Number: 4,852,635

[45] Date of Patent: Aug. 1, 1989

[54] METHOD OF ELECTROMAGNETIC STIRRING IN CONTINUOUS METAL CASTING PROCESS

[75] Inventors: Toshiyasu Onishi; Kenzo Ayata, both of Kobe; Hiroshi Takagi; Yasuo Suzuki, both of Hyogo; Yasuhiko Ohta, Kobe; Takeo Shiozawa; Koichi Fujiwara, both of Hyogo; Masakazu Itashiki, Kobe, all of Japan

[73] Assignee: Kabushiki Kaisha Kobe Seiko Sho, Kobe, Japan

[21] Appl. No.: 669,722

[22] Filed: Nov. 8, 1984

Related U.S. Application Data

[63] Continuation of Ser. No. 438,653, Nov. 2, 1982, abandoned.

[30] Foreign Application Priority Data

Nov. 6, 1981 [JP] Japan ..... 56-178803

[51] Int. Cl.[4] ..... B22D 11/10

[52] U.S. Cl. ..... 164/468; 164/504

[58] Field of Search ..... 164/468, 499, 504

[56] References Cited

U.S. PATENT DOCUMENTS

| | | | |
|---|---|---|---|
| 4,016,926 | 4/1977 | Yamada et al. | 164/468 |
| 4,040,467 | 8/1977 | Alberny et al. | 164/504 |
| 4,103,730 | 8/1978 | Dussart | 164/468 |
| 4,321,958 | 3/1982 | Delassus | 164/468 |
| 4,419,177 | 12/1983 | Pryor | 164/504 |

FOREIGN PATENT DOCUMENTS

| | | | |
|---|---|---|---|
| 0028761 | 4/1981 | European Pat. Off. | 164/468 |
| 2324397 | 4/1977 | France | 164/468 |
| 0154356 | 9/1982 | Japan | 164/468 |

*Primary Examiner*—Kurt Rowan

*Attorney, Agent, or Firm*—Oblon, Spivak, McClelland, Maier & Neustadt

[57] ABSTRACT

A method of electromagnetically stirring molten metal in an unsolidified portion of a continuously cast strand by a magnetic field formed by applying alternating current to at least two exciting coils, the method comprising: supplying to one of the exciting coils a first alternating current of a frequency in the range of 1–60 Hz and to the other one of the exciting coils a second alternating current with a frequency difference in the range of 0.03–0.25 Hz from the first alternating current to form a varying composite magnetic field thereby to induce stirred movement of varying direction and intensity in the molten metal.

4 Claims, 7 Drawing Sheets

○---CENTER SEGREGATION ≦1.15
●---CENTER SEGREGATION >1.15
0.3
0.2
0.1
0
10
20
50
60
FREQUENCY (Hz)
APPROPRIATE FREQUENCY DIFFERENCE
(fu − fv) (Hz)

METHOD OF ELECTROMAGNETIC STIRRING IN CONTINUOUS METAL CASTING PROCESS

This application is a continuation of application Ser. No. 438,653 filed Nov. 2, 1982 now abandoned.

BACKGROUND OF THE INVENTION

1. Field of the Invention

This invention relates to a method of electromagnetic stirring in continuous metal casting processes, and more particularly to a method of electromagnetic stirring in which alternating currents of different frequencies are applied to a set of exciting coils thereby to induce electromagnetic stirring actions which can effectively stir molten steel in unsolidified portions of a continuously cast strand to reduce center segregation for manufacturing cast products of good quality.

2. Description of the Prior Art

There have already been proposed electromagnetic stirring methods of this sort, for example, in Japanese Pat. Publication No. 52-4495, wherein the unsolidified portions of molten metal of a continuously cast strand (hereinafter referred to as "c. c. strand" for brevity) are electromagnetically stirred by a magnetic field induced by alternating current which is intermittently applied to an exciting coil. This method is intended to produce a regular flow of molten metal in the time period when alternating current flows through the exciting coil, and to produce temporary inertial turbulence in the regular flow of the molten metal by interruption of the alternating current, thus utilizing the mixing and stirring actions of the rectified and turbulent flows. One problem with this method is that, in the period of regular flow which exists invariably by intermittent application of alternating current, a distinct white band appears due to the rotational flows which take place during the regular flow period, resulting in the acceleration of dense segregation in the core portion of the molten metal. Also proposed in Japanese Pat. Publication No. 53-6932 is a stirring method using an electromagnetic stirrer for applying electromagnetic force to the unsolidified portion at the center of continuously cast steel, switching the direction of current to be applied to the electromagnetic stirrer. This method, however, also has a drawback in that, when current in one direction is initially applied to the molten steel for an extended period of time, a distinct white band appears due to the regular flow, and when current is applied to the molten steel for a short period of time, molten steel flow is obstructed by an abrupt change in stirring direction. Therefore it is difficult to make the temperature of the molten pool uniform, thus hindering the production of an equiaxed crystal zone.

SUMMARY OF THE INVENTION

It is therefore an object of the present invention to eliminate the above-mentioned drawbacks or problems of the conventional methods in electromagnetic stirring in continuous metal casting processes in which unsolidified portions of a c.c. strand are stirred electromagnetically by a magnetic field induced by alternating current flowing through exciting coils.

More particularly, it is an object of the present invention to provide a method of electromagnetic stirring which can generate a stirring force incessantly varying in direction and intensity thereby to accelerate uniform mixing and stirring by continuous turbulent actions. As a result of such turbulent stirring actions, the temperature of the molten pool is made uniform, preventing remelting of equiaxed crystal nuclei which are produced by the break-up of columnar crystals, thereby forming a broad equiaxed crystal zone in the center portion of the cast product and at the same time washing the solidification front from various directions to suppress the production of a white band.

According to the present invention, there is provided a method of electromagnetically stirring molten metal in an unsolidified portion of a continuously cast strand in a continuous casting process by magnetic field formed by applying alternating current to at least two exciting coils, the method comprising: supplying to one of the exciting coils a first alternating current of a frequency in the range of 1–60 Hz and supplying to the other one of the exciting coils a second alternating current with a frequency difference in the range of 0.03–0.25 Hz from the first alternating current to form a varying composite magnetic field thereby to induce stirred movement for varying direction and intensity in the molten metal.

The above and other objects, features and advantages of the present invention will become apparent from the following description and appended claims, taken in conjunction with the accompanying drawings which show by way of example some preferred embodiments of the invention.

DESCRIPTION OF THE PREFERRED EMBODIMENTS

Figure 1A:
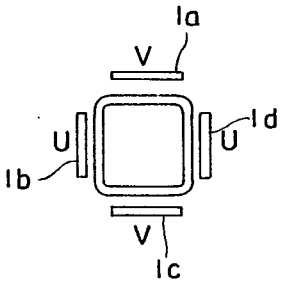
FIGS. 1(A) to 1(C) are schematic views of electromagnetic stirrers each with a set of exciting coils which are supplied with alternating currents of different frequencies according to the method of the present invention.

According to the electromagnetic stirring method of the present invention, the alternating currents to be applied to a set of exciting coils are in the frequency range of 1–60 Hz and have a frequency difference of 0.03–0.25 Hz from each other. In a case where it is intended to stir molten steel within a mold or in the final solidification zone of a large sized continuous casting strand by electromagnetic stirring, it is preferable to apply alternating currents of low frequency, for example of 1–20 Hz to let the magnetic force reach the molten steel through the solidified shell of a cast strand or the mold wall.

The above-defined frequency difference is determined from the standpoint of producing an equiaxed crystal zone while suppressing the segregation ratio.

Upon applying alternating currents of different frequencies of the above-defined ranges to the exciting coils, the magnetic field which is induced by the exciting coils incessantly changes its direction and intensity, as a result varying the direction of movement of molten steel in the cast strand as well as the intensity of the stirring force in a suitable manner. By this phenomenon, the molten steel in the center portion of the molten pool is stirred sufficiently enough to cause a uniform temperature distribution which produces a broad equiaxed crystal zone, and, in contrast to the conventional stirring in which the solidification front is washed only in one direction, the alloy elements in the mushy zone are washed out irregularly in the turbulent stirring flow so that a white band in such a distinctive form as would result from conventional stirring does not appear. Further, since a broad equiaxed crystal zone can be obtained by relatively weak stirring, there is no possibility of forming a dense segregation zone due to accumulation of alloy elements which are washed out from the white band. Thus, cast products of good quality are produced by reducing and improving the center segregation.

The frequency difference of alternating currents to be supplied to a set of exciting coils is preferred to be in the range of 0.04–0.20 Hz in the case of stirring at 1–20 Hz, and in the range of 0.06–0.20 Hz in the case of stirring at 50–60 Hz for further lowering the segregation ratio.

According to the method of the present invention, the molten steel in the cast strand is not limited to movement in a particular direction, but is preferably moved about the axis of the strand. The electromagnetic stirring may be effected on the metal within the casting mold or on the cast strand in the intermediate solidifying zone, or at two or more positions including the aforementioned positions.

Hereafter, the invention is described more particularly by way of preferred embodiments shown in the drawings.

Figure 2:
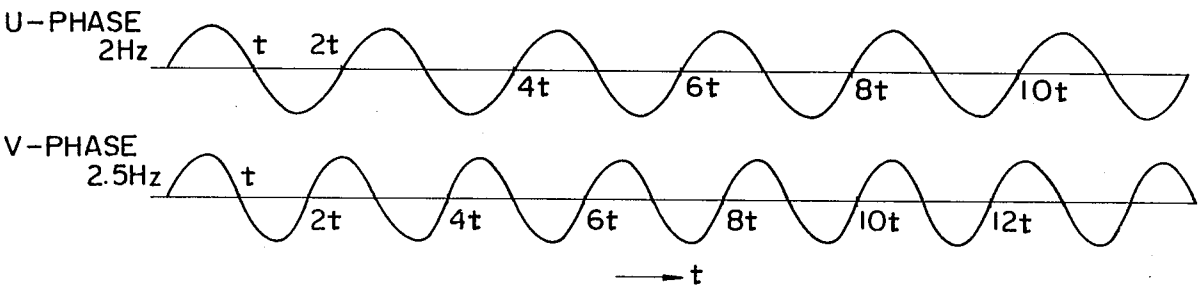
FIG. 2 is a frequency diagram of the alternating currents to be supplied to the respective electromagnetic coils of FIG. 1.
Figure 3:
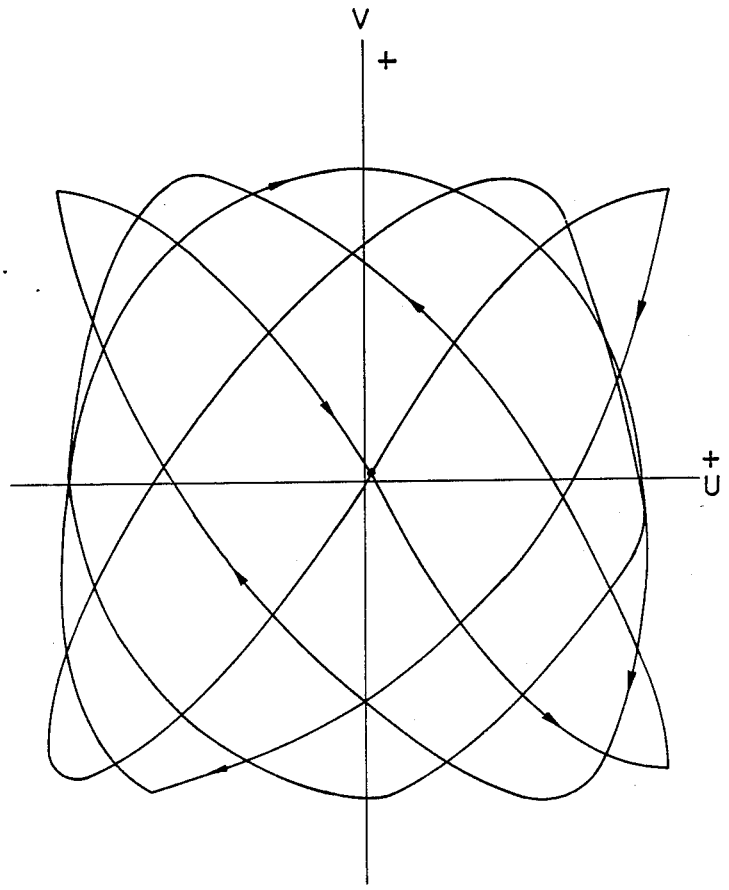
FIG. 3 is a diagrammatic illustration of the locus of a composite magnetic field vector which is produced by supplying the alternating currents of FIG. 2 to the electromagnetic coils of FIG. 1, respectively.

Referring to FIG. 1, there is schematically shown an electromagnetic stirring unit which is employed in the method of the present invention for use particularly in continuous casting processes of molten metal, which is adapted to impose turbulent stirring actions on the residual molten steel in a c. c. strand by means of the rotational magnetic fields of electromagnetic coils 1*a* to 1*d* thereby to prevent production or growth of dense segregation, columnar crystals, and a white band. The electromagnetic coils 1*a* to 1*d* are located symmetrically on four peripheral surfaces of a cast block of a square shape in section at a predetermined distance from each other. A pair of electromagnetic coils 1*a* and 1*c* which are located on the upper and lower sides of the cast block in FIG. 1 are used for V-phase, while the other pair of electromagnetic coils 1*b* and 1*d* on the left and right sides of the cast block are used for U-phase. As shown in FIG. 2, alternating currents of 2 Hz and 2.5 Hz are continuously supplied to the electromagnetic coils of V-phase and U-phase, respectively, to apply the residual molten steel in the c. c. strand with a composite magnetic field which is formed by dual-phase alternating currents of different frequencies. The direction and intensity of this composite magnetic field is incessantly varied, for example, as shown in FIG. 3 repeating a cycle of movement turning away from the center origin of the initial starting point where the frequencies of both phases are zero and then returning to the center origin, varying the intensity of the magnetic field continuously in various manners, thereby causing turbulent flow in the residual molten steel in the c. c. strand, to mix it uniformly. The variations in the direction of movement and intensity of such a magnetic field are reflected by the flow of stirred molten steel in the molten pool which takes place in every direction and reverses its direction of movement incessantly. Consequently, turbulent stirring is produced to accelerate the mixing of the molten steel or the molten pool, preventing formation of a dense segregation zone in the core portion while encouraging the growth of equiaxed crystals, coupled with the effect of suppressing the white band by stirring the solidification front in diversified directions.

In conventional electromagnetic stirring, the stronger the stirring force, the more the equiaxed crystal cores by breakage of columnar crystals are produced to form a broad equiaxed crystal zone. However, the strong stirring force produced by the conventional methods can produce simply stirs of regular flow which preferentially washes the solidification front, so that the molten steel in the mushy zone with concentrated alloy elements is washed out to form a negative segregation zone or the so-called white band. The washed-out alloy elements accumulate in the residual molten steel and form a core of dense segregation zone, accelerating the center segregation. On the other hand, in the case of weak stirring by the conventional method, the formation of the white band is suppressed to some extent but there seldom occurs the break-up of columnar crystals, accordingly resulting in formation of a minimized equiaxed crystal zone. In addition, the conventional regular flow stirring has almost no stirring effect on the molten steel in the center portion of the molten pool, in most cases failing to attain uniform temperature distribution, so that the equiaxed crystal nuclei which are produced by the break-up of columnar crystals are easily remelted, which is disadvantageous for the formation of the equiaxed crystal zone.

In contrast, according to the method of the present invention, the direction and force of movement of the molten steel in the molten pool are varied sequentially so that even the molten steel in the center portion of the molten pool is stirred sufficiently, resulting in uniform temperature distribution, and forming a broad equiaxed crystal zone. By such turbulent stirring, the alloy elements in the mushy zone are washed out irregularly without forming a clear white band as observed in conventional stirring in which the solidification front is washed in only one direction. Further, a broad equiaxed crystal zone can be obtained with relatively weak stirring, so that there is no possibility of a concentrated segregation zone being formed by accumulation of alloy elements which would be otherwise washed out from a white band. Therefore the center segregation is reduced by a significant degree.

Figure 1B:
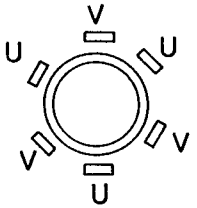
Figure 1C:
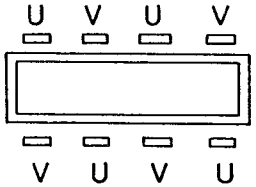

Although a set of electromagnetic coils is employed in the above-described embodiment, three pairs of exciting coils may be provided at equidistant positions around the periphery of a cast block as shown particularly in FIG. 1*b*. Alternatively, the electromagnetic stirrer unit may be constituted by a cast block of a rectangular shape in section as shown in FIG. 1*c*, which is provided with a plural number of paired exciting coils according to the size thereof. In these cases, the adjacently located exciting coils are supplied with alternating currents with a frequency difference of 0.03–0.25 Hz to produce the same turbulent stirring effect as described hereinbefore.

EXAMPLE

The electromagnetic stirring method of the invention was tested in comparison with the conventional method in a continuous casting process of 0.6%C steel of a composition consisting of 0.61%C, 1.65%Si, 0.85%Mn, 0.025%P, 0.020%S and 0.030%Al.

The 0.6%C steel was continuously cast by a continuous casting machine having a size of 300×400 mm in section, with a drawing speed of 0.9 m/min and a superheating of 50° C. for the molten steel in the tundish. The electromagnetic stirring was effected at the frequencies of 2, 10 and 20 Hz at a position where the thickness of the solidified shell of the c.c. strand was 105 mm, and also at the frequencies of 50 and 60 Hz at a portion where the shell thickness was 55 mm. The flux density of the magnetic field at the surface of the continuously cast strand was about 1100 gauss and 250 gauss, respectively.

The range of the flux density of the magnetic field at the surface of the continuously cast strand is set to be 100 to 2300 gauss in the present invention. When the flux density of the magnetic field is less than 100 gauss, the stirring flow of molten steel is insufficient to form an equiaxed crystal zone and to reduce the center segregation. When the flux density of the magnetic field is over 2300 gauss, the stirring flow of molten steel is too vigorous resulting in the appearance of a strong white band.

Figure 4:
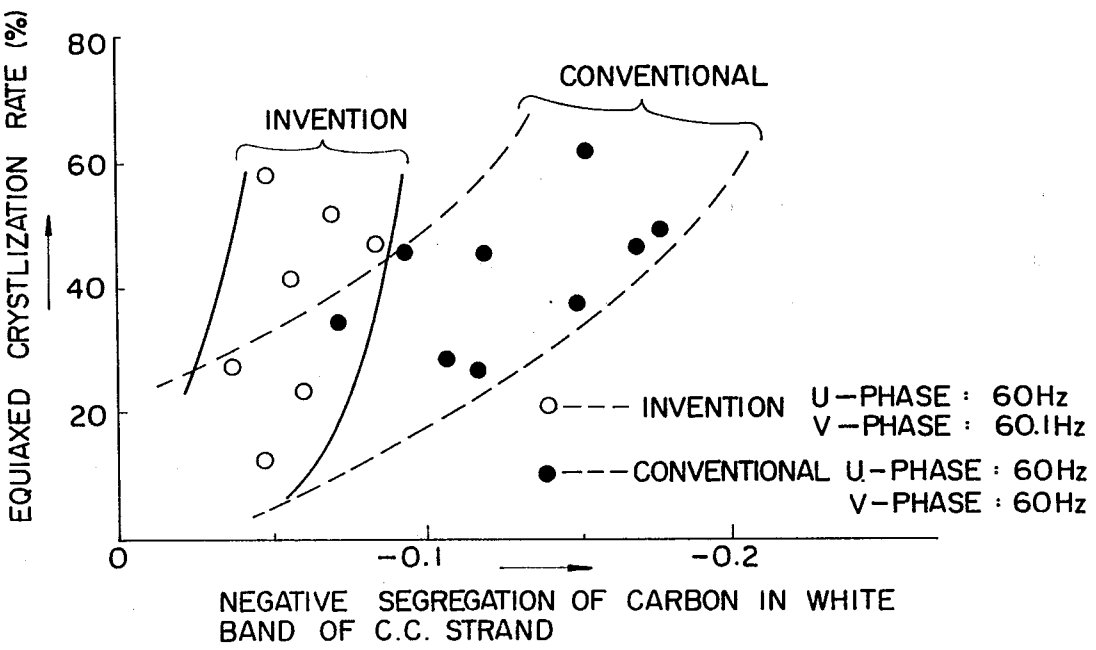
FIG. 4 is a graphic representation of the relationship between the negative segregation ratio of carbon in the white band and the equiaxed crystallization ratio in c. c. strands in stirring operations by the method of the present invention and the conventional method.
Figure 5:
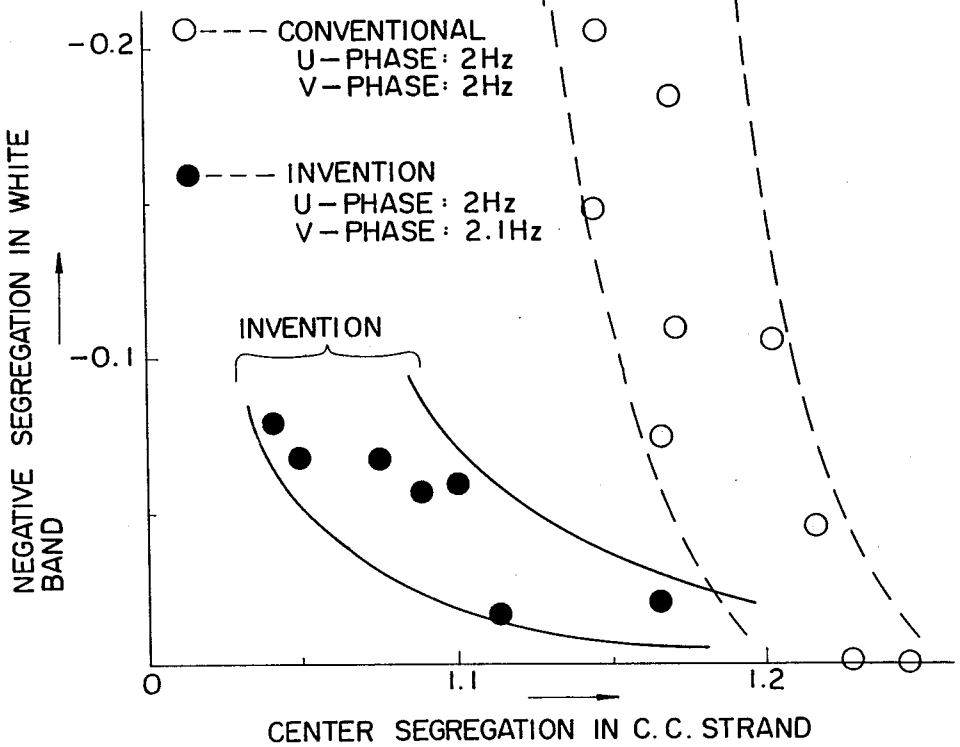
FIG. 5 is a graphic representation of the relationship between the center segregation ratio of carbon and the negative segregation ratio of carbon in the white band of c. c. strands in stirring operations by the method of the present invention and the conventional method.

FIG. 4 shows the relationship between the negative segregation ratio of carbon in the white band and the equiaxed crystallization ratio in the stirring method of the present invention employing different frequencies of 60Hz and 60.1Hz and in the conventional stirring method with no frequency difference. As seen therefrom, the method of the present invention shows a remarkably increased equiaxed crystallization ratio at the same negative segregation ratio. Here, the negative segregation ratio in the white band is expressed by Concentration of alloy Average concentration elements in white band-of alloy elements in steel FIG. 5 shows the relationship between the center segregation ratio of carbon in the c. c. strand and the negative segregation ratio of carbon in the white band for the stirring method of the present invention employing different frequencies of 2 Hz and 2.1 Hz and in the conventional stirring method with no frequency difference. It is clear therefrom that the method of the present invention has a large drop in the center segregation ratio at the same negative segregation ratio in the white band. Here, the center segregation ratio is expressed by $$= \frac{\text{Concentration of alloy elements center portion of c. c. strand}}{\text{Average concentration of alloy elements in steel}}$$

Figure 6:
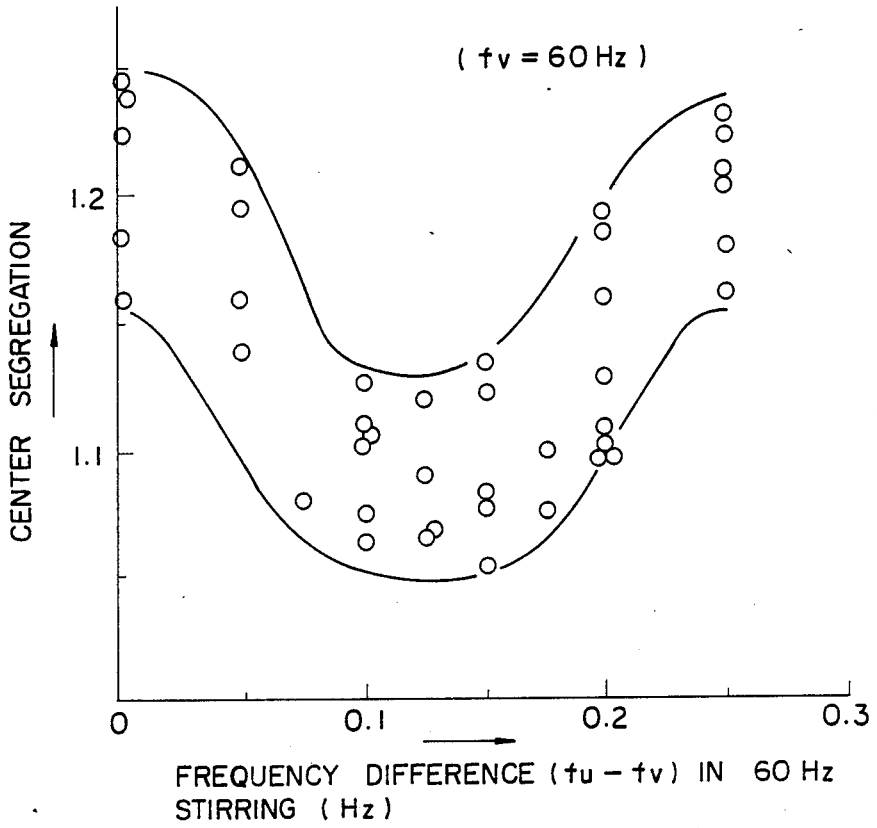
FIG. 6 is a graphic representation of the relationship between the frequency difference and the center segregation ratio of carbon in stirring operations at 60 Hz according to the method of the present method.
Figure 7:
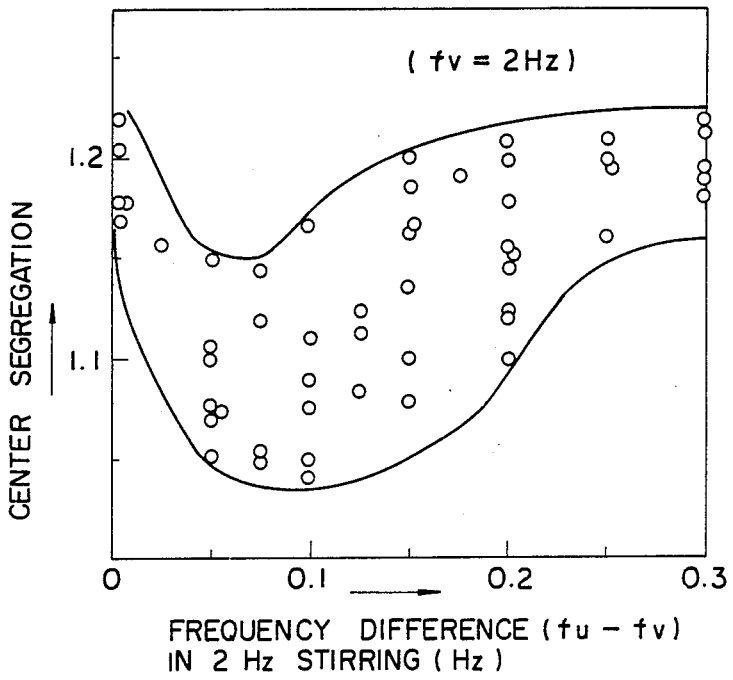
FIG. 7 is a graphic representation of the relationship between the frequency difference and the center segregation ratio of carbon in stirring operations at 2 Hz according to the method of the present invention.

FIGS. 6 and 7 plot the variations in the center segregation ratio of carbon in stirring operations employing the frequency of 60 Hz and 2 Hz for one phase, respectively, while increasing the frequency of the other phase, showing that the center segregation ratio can be suppressed by holding the frequency difference between the two phases in the range of 0.03–0.25 Hz. The center segregation ratio is further reduced with a frequency difference in the range of 0.06–0.20 Hz in the case of stirring at 60 Hz as shown in FIG. 6, and with a frequency difference in the range of 0.04–0.20 Hz in the case of stirring at 2 Hz as shown in FIG. 7.

Figure 8:
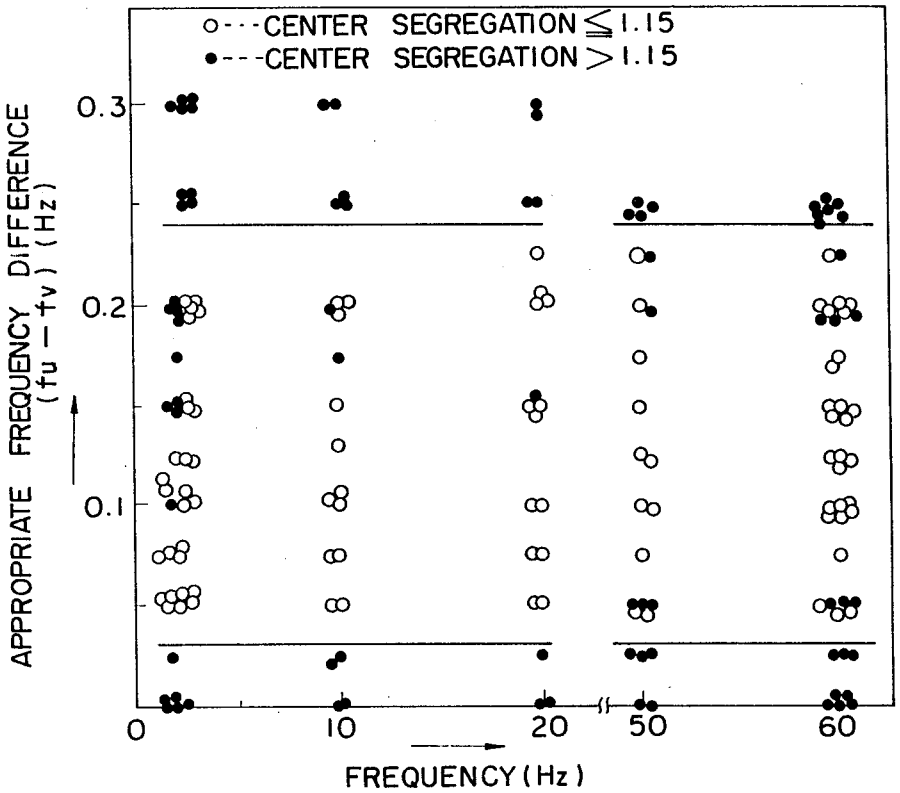
FIG. 8 is a diagram of an appropriate frequency difference range in stirring operations at different frequencies according to the method of the present invention.

Referring now to FIG. 8, the effects of the frequency difference on the improvement of the center segregation in stirring operations at 2, 10, 20, 50 and 60 Hz are shown (such improvement means a centersegregation ratio of carbon of 1.15.). In the case of 2, 10 and 20 Hz, the appropriate frequency difference within the range of the present invention (0.03 to 0.25 Hz) provides almost no change in the improvement of centersegregation. In the case of 50 and 60 Hz, there is also no change in the improvement of center segregation within such range of frequency.

Although not shown in the foregoing example, a similar turbulent stirring effect can be produced by varying the frequency of V-phase continuously in the range of 0.03–0.25 Hz while holding the U-phase at a constant frequency. Further, a similar effect can be obtained by electromagnetically stirring the molten steel in the mold by the method of the present invention, instead of the electromagnetic stirring in the intermediate and final solidifying zones as shown in the foregoing example.

As is clear from the foregoing description and example, the present invention concerns a method of electromagnetic stirring of molten steel in the unsolidified portion of a c. c. strand during the continuous casting process by means of a magnetic field which is formed by applying alternating current to at least one set of exciting coils located around the circumference of the c. c. strand, and is characterized in that alternating currents of difference frequencies are supplied to the respective exciting coils to form a composite magnetic field which constantly varies its rotational direction and intensity. Thus, the present invention provides an electromagnetic stirring method which is very simple and yet capable of producing a continuously cast product of good quality.

Needless to say, the method of the present invention has a wide range of application and high practical value, and can be applied to a horizontal type continuous casting machine as well as a vertical type continuous casting machine.

Obviously, numerous (additional) modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of electromagnetically stirring molten metal in an unsolidified portion of a continuously cast strand by a magnetic field formed by applying alternating current to at least one group of exciting coils comprising at least two exciting coils, wherein said method comprises:

supplying to one of said exciting coils in each group a first alternating current of a frequency in the range of 1–60 Hz and to the other one of said exciting coils in each group a second alternating current with a frequency different in the range of 0.03–0.25 Hz from said first alternating current to form a varying composite magnetic field thereby to induce stirred movement of varying direction and intensity in said molten metal.

2. The method as set forth in claim 1, wherein said one of said exciting coils in each group is supplied with a first alternating current of a frequency in the range of 1–20 Hz while the other one of said exciting coils in each group is supplied with a second alternating current with a frequency difference of 0.04–0.20 Hz from said first alternating current.

3. The method as set forth in claim 1, wherein said one of said exciting coils in each group is supplied with a first alternating current of a frequency in the range of 50–60 Hz while the other one of said exciting coils in each group is supplied with a second alternating current with a frequency difference in the range of 0.06–0.2 Hz from said first alternating current.

4. The method as set forth in claim 1, wherein said composite magnetic field has a maximum flux density in the range of 100–2300 gauss at the surface of said continuously cast strand.

* * * * *